US010164357B2

(12) United States Patent
Wang et al.

(10) Patent No.: US 10,164,357 B2
(45) Date of Patent: Dec. 25, 2018

(54) CONNECTING TERMINAL AND POWER DISTRIBUTING UNIT USING THE SAME

(71) Applicant: CLOUD NETWORK TECHNOLOGY SINGAPORE PTE. LTD., Singapore (SG)

(72) Inventors: Chia-Peng Wang, New Taipei (TW); Gi-Lung Lin, New Taipei (TW)

(73) Assignee: Cloud Network Technology Singapore Pte. Ltd., Singapore (SG)

( * ) Notice: Subject to any disclaimer, the term of this patent is extended or adjusted under 35 U.S.C. 154(b) by 20 days.

(21) Appl. No.: 15/473,833

(22) Filed: Mar. 30, 2017

(65) Prior Publication Data

US 2018/0183156 A1 Jun. 28, 2018

(30) Foreign Application Priority Data

Dec. 23, 2016 (CN) ..... 2016 1 1208192

(51) Int. Cl.

| | |
|---|---|
| ***H01R 4/66*** | (2006.01) |
| ***H01R 11/32*** | (2006.01) |
| ***H01R 9/24*** | (2006.01) |
| ***H01R 4/18*** | (2006.01) |
| ***H01R 4/34*** | (2006.01) |
| ***H01R 13/02*** | (2006.01) |
| ***H01R 13/514*** | (2006.01) |
| ***H01R 13/518*** | (2006.01) |
| ***H01R 13/639*** | (2006.01) |
| *H01R 103/00* | (2006.01) |
| *H01R 11/12* | (2006.01) |
| *H01R 25/00* | (2006.01) |

(52) U.S. Cl.

CPC ..... *H01R 11/32* (2013.01); *H01R 4/18* (2013.01); *H01R 4/34* (2013.01); *H01R 9/2458* (2013.01); *H01R 13/02* (2013.01); *H01R 13/514* (2013.01); *H01R 13/518* (2013.01); *H01R 13/639* (2013.01); *H01R 11/12* (2013.01); *H01R 25/006* (2013.01); *H01R 2103/00* (2013.01)

(58) Field of Classification Search

CPC .... H01R 13/652; H01R 25/006; H02H 3/093; H01L 23/552

USPC ..... 439/106, 107; 361/118, 95

See application file for complete search history.

(56) References Cited

U.S. PATENT DOCUMENTS

| | | | | |
|---|---|---|---|---|
| 7,457,106 | B2 * | 11/2008 | Ewing | H01R 25/006 340/635 |
| 7,726,825 | B2 * | 6/2010 | Mandapat | H01R 25/003 361/118 |
| 8,052,437 | B2 * | 11/2011 | Jiang | H01R 25/003 439/106 |
| 2009/0213567 | A1 * | 8/2009 | Mandapat | H01R 13/7175 362/95 |

* cited by examiner

*Primary Examiner* — Phuong Chi T Nguyen

(74) *Attorney, Agent, or Firm* — ScienBiziP, P.C.

(57) ABSTRACT

A connecting terminal in a power distribution unit includes a connecting plate and a first wire joint. The connecting plate includes first and second ends. The first end defines a first locking hole. The first wire joint is configured to be connected to an end of a wire, the connecting terminal is connected a power interface of an external device through the first locking hole. The power distributing unit having the connecting terminal is further disclosed.

7 Claims, 4 Drawing Sheets

CONNECTING TERMINAL AND POWER DISTRIBUTING UNIT USING THE SAME

FIELD

The subject matter herein generally relates to a connecting terminal and power distributing units using the connecting terminal.

BACKGROUND

Power distribution units (PDU) are utilized to distribute power to one or more associated electronic devices. These PDUs often have a housing, a power input for delivering power to the housing, and one or more power outlets mounted in the housing for distribution of power from the input to other electronic units.

BRIEF DESCRIPTION OF THE DRAWINGS

Implementations of the present technology will now be described, by way of example only, with reference to the attached figures.

DETAILED DESCRIPTION

Figure 1:
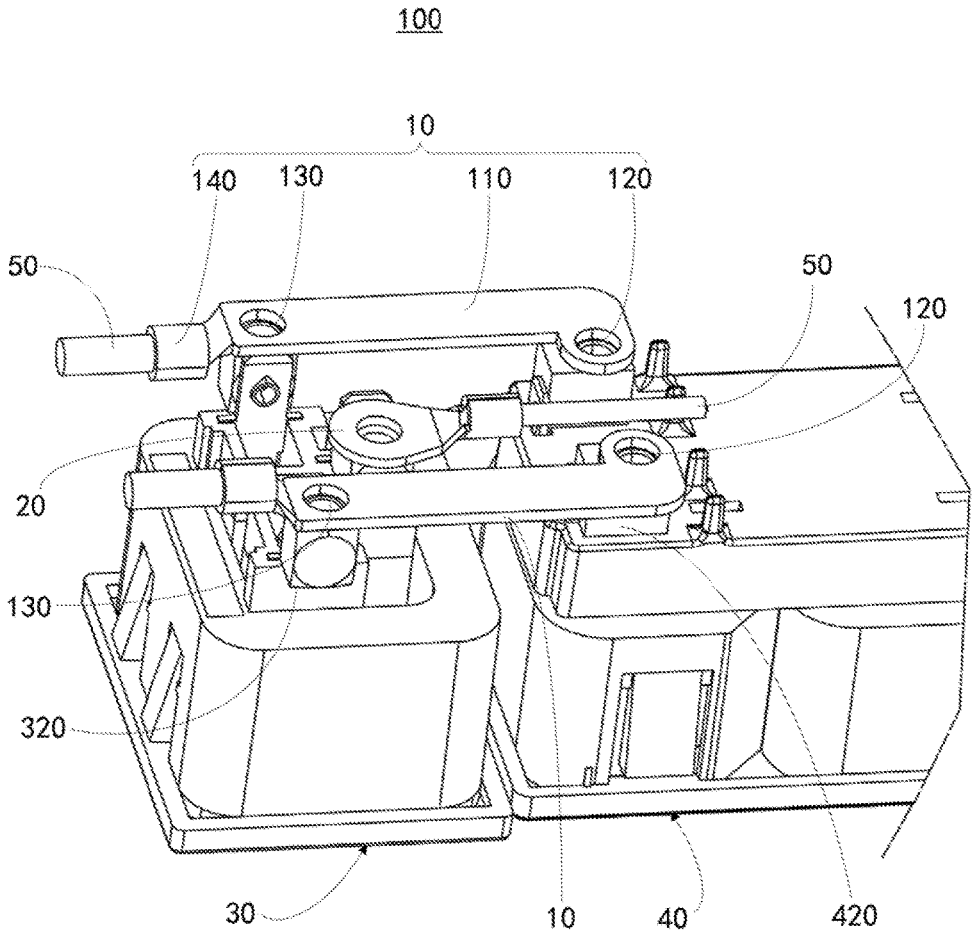
FIG. 1 is an isometric view of an exemplary embodiment of a portion of a power distributing unit.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
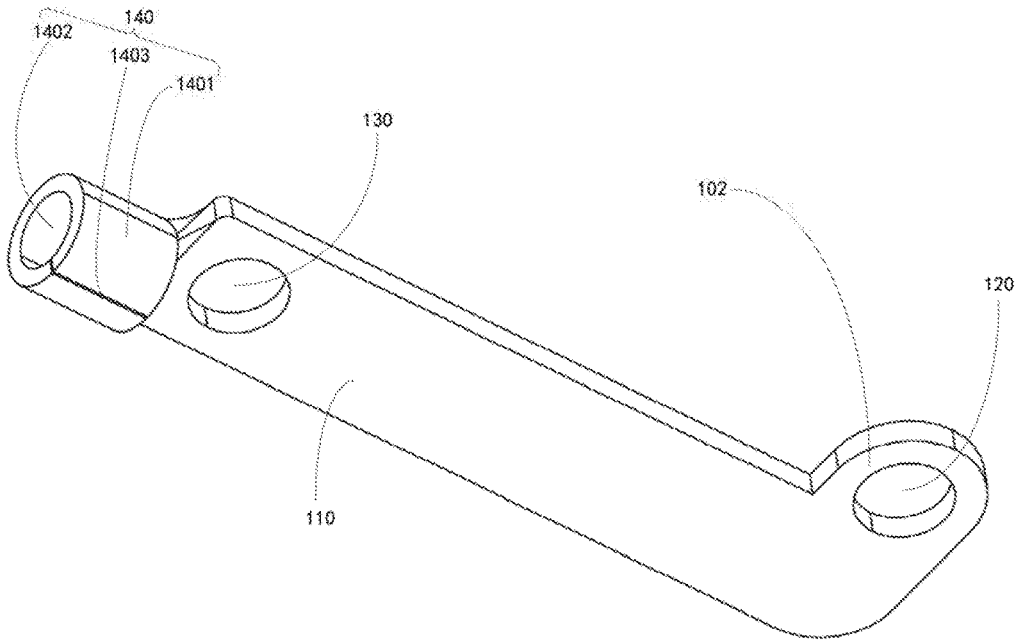
FIG. 2 is an isometric view of the first connecting terminal of the power distributing unit of FIG. 1.
Figure 3:
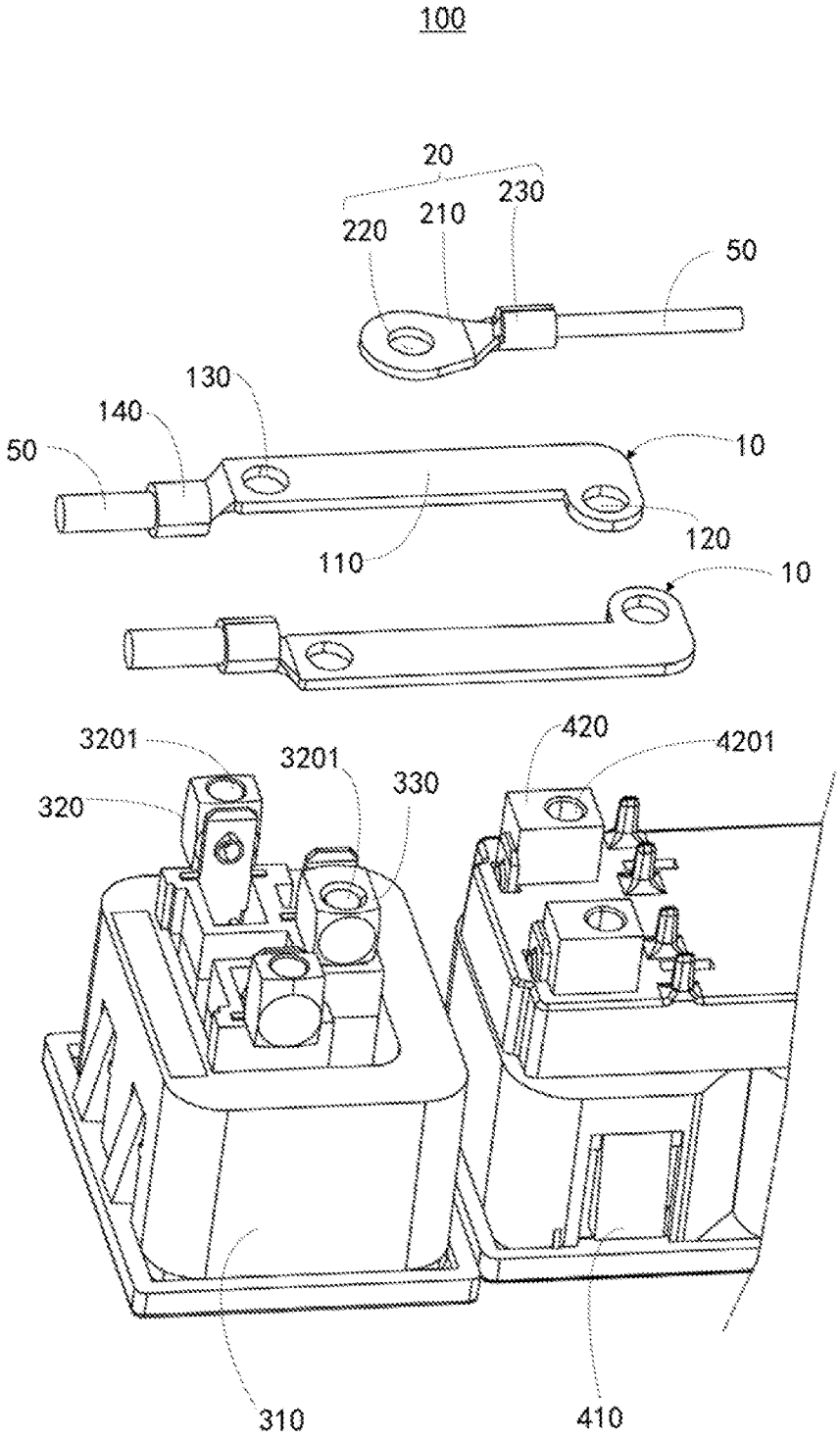
FIG. 3 is an exploded view of a portion of the power distributing unit of FIG. 1.

FIGS. 1 to 3 illustrate various portions of a power distributing unit 100 according to an exemplary embodiment of the present application. In order to show more details, the power distributing unit 100 is partially shown in FIG. 1 through FIG. 3.

The power distributing unit 100 includes a first power distributing socket 30, a second power distributing socket 40, a first connecting terminal 10, and a second connecting terminal 20. The first connecting terminal 10 and the second connecting terminal 20 each are connected between the first power distributing socket 30 and the second power distributing socket 40. The power distributing unit 100 in the present exemplary embodiment includes one first power distributing socket 30 and one second power distributing socket 40. In other exemplary embodiments, the number of the first and second power distributing sockets 30 and 40 may vary.

In FIG. 3, the first power distributing socket 30 can be a C19 type socket. The first power distributing socket 30 can include a first chassis 310 and circuit unit (not explicitly shown) embedded in the first chassis 310. The circuit unit defines two first bonding posts 320 and a third bonding post 330. The two first bonding posts 320 can be respectively connected to a neutral line and a live line (not explicitly shown) of the circuit unit, the third bonding post can be connected to a ground line (not explicitly shown) of the circuit unit. Each of the two first bonding posts 320 and the third bonding post 330 defines a fourth locking hole 3201.

The second power distributing socket 40 can be a C13 type socket. The second power distributing socket 40 can include a second chassis 410 and circuit unit (not explicitly shown) embedded in the second chassis 410. The circuit unit embedded in the second chassis 410 defines two second bonding posts 420. The two second bonding posts 420 can be respectively connected to a neutral line and a live line (not explicitly shown) of the circuit unit embedded in the second chassis 410. Each of the two second bonding posts 420 defines a fifth locking hole 4201.

The first connecting terminal 10 includes a first connecting plate 110 and a first wire joint 140. The first connecting plate 110 includes a first end and a second end opposite to the first end. The first end defines a first locking hole 120. The first wire joint 140 is connected to the second end of the first connecting plate 110. The second end of the first connecting plate 110 defines a second locking hole 130.

The first connecting terminal 10 is used to connect the first bonding posts 320 of the first power distributing socket 30 and the second bonding posts 420 of the second power distributing socket 40. The first locking hole 120 of the first connecting terminal 10 is coupled with the fifth locking hole 4201 of the second bonding posts 420 and is locked by a locking member (not shown).

The locking members can be bolts. Correspondingly, the first bonding post 320 and the second bonding post 420 can be screw nuts, and the fifth locking hole 4201 can be a screw hole. The first locking hole 120 can be a through hole. The fifth locking hole 4201 aligns with the first locking hole 120 and a bolt can pass through the first locking hole 120 and engage in the fifth locking hole 4201 to lock the first end of the first connecting plate 110 to the second bonding post 420. Similarly, the second locking hole 130 aligns with a fourth locking hole 3201 and a bolt can pass through the second locking hole 130 and engage in the fourth locking hole 3201 to lock the second end of the first connecting plate 110 to the second bonding post 420. The first power distributing socket 30 and the second power distributing socket 40 are then electrically connected by two first connecting terminals 10.

The first wire joint 140 connects to an end of a wire 50, the other end of the wire 50 can be connected to external device, such as a power source or a circuit breaker. The first wire joint 140 can be a circular clamping member. As illustrated in FIG. 2, the first wire joint 140 can include a clamping body 1401, the clamping body 1401 can be made of flexible materials. The clamping body 1401 of the first wire joint 140 defines a groove 1403 parallel with an axial direction of the clamping body 1401. An end of the wire 50 is received in a receiving hole 1402 of the clamping body 1401 and clamped by the clamping body 1401.

The second connecting terminal 20 can be used to connect an end of a wire 50 to the ground line of the circuit unit of the first power distributing socket 30. The second connecting terminal 20 includes a second connecting plate 210 and a second wire joint 230. The second connecting plate 210 includes a first end and a second end opposite to the first end, the first end defines a third locking hole 220. The second wire joint 230 is connected to the second end of the second connecting plate 210. A fourth locking hole 3201 of the third bonding post 330 aligns with the third locking hole 220 and a bolt can pass through the third locking hole 220 and engage in the fourth locking hole 3201 to lock the first end of the second connecting plate 210 to the third bonding post 330.

Figure 4:
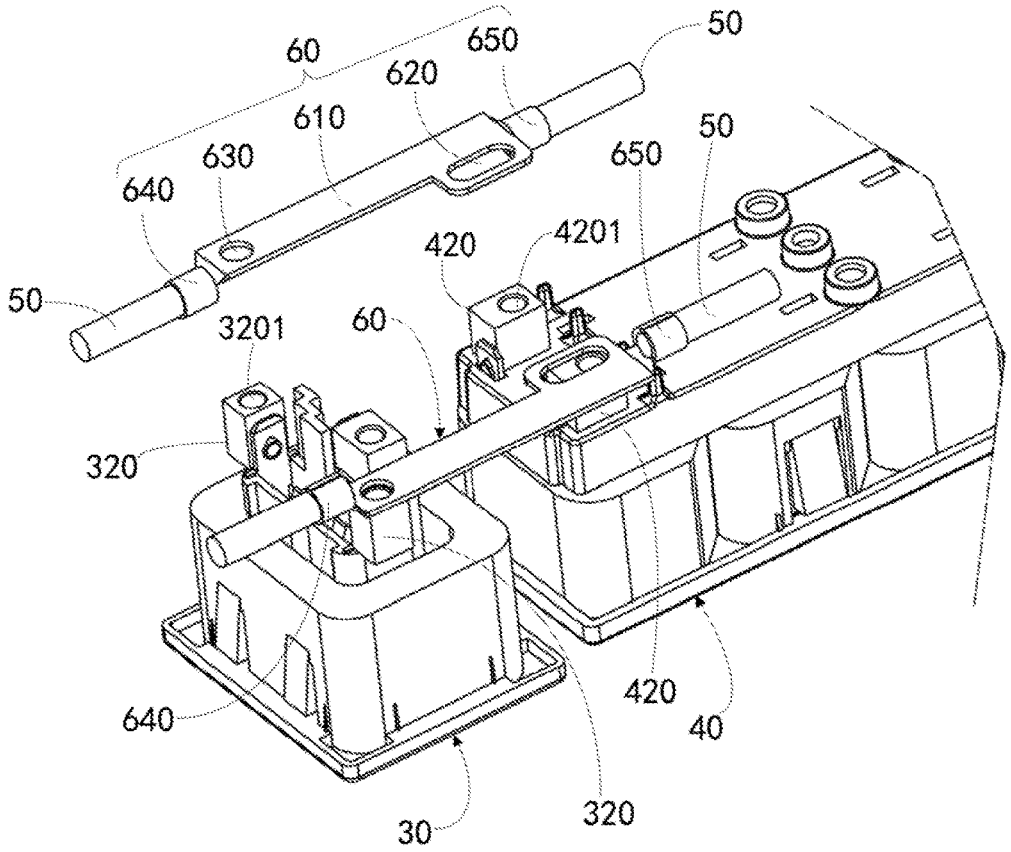
FIG. 4 is an isometric view of a portion of another exemplary embodiment of a power distributing unit.

Referring to FIG. 4, in another exemplary embodiment, the first power distributing socket 30 and the second power distributing socket 40 can be connected by a third connecting terminal 60. The third connecting terminal 60 is connected between the first bonding post 320 and the second bonding post 420.

The third connecting terminal 60 includes a first connecting plate 610 and a first wire joint 640. The first connecting plate 610 includes a first end and a second end opposite to the first end and the first end defines a first locking hole 620. The first wire joint 640 is connected to the second end of the first connecting plate 610. The second end of the first connecting plate 610 defines a second locking hole 630.

The third connecting terminal 60 is similar to the first connecting terminal 10, the difference being that the third connecting terminal 60 further includes a third wire joint 650. The third wire joint 650 is connected to the first end of the first connecting plate 610. The first wire joint 640 and the third wire joint 650 can be respectively connected to two ends of two different wires 50, for example, the first wire joint 640 can be connected to an input wire 50 and the third wire joint 650 can be connected to an output wire 50.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. A power distributing unit comprising:

a first power distributing socket comprising a first chassis and a first circuit unit embedded in the first chassis, wherein the first circuit unit defines a first bonding post, a fourth locking hole is defined on the first bonding post; and a connecting terminal connected to the first bonding post, wherein the connecting terminal comprising:

a connecting plate comprising a first end and a second end opposite to the first end, the first end defines a first locking hole coupling with the fourth locking hole; and a first wire joint connected to the second end;

wherein the first wire joint is configured to be connected to an end of a wire, the connecting terminal is connected to the first bonding post through the first locking hole and the fourth locking hole;

wherein the power distributing unit further comprises a second power distributing socket, the second power distributing socket comprises a second chassis and a second circuit unit embedded in the second chassis, wherein the second circuit unit defines a second bonding post a fifth locking hole is defined on the second bonding post;

wherein the connecting terminal further comprises a third wire joint, the third wire joint is connected to the first end of the connecting plate.

2. The power distributing unit of claim 1, wherein the connecting terminal further comprises a second locking hole defined on the second end of the connecting plate, the connecting terminal is connected to the second bonding post through the second locking hole and the fifth locking hole.

3. The power distributing unit of claim 2, wherein the first locking hole and the second locking hole are through holes, the fourth locking hole and the fifth locking hole are screw holes.

4. The power distributing unit of claim 2, wherein the first bonding post and the second bonding post are screw nuts.

5. The power distributing unit of claim 1, wherein the first wire joint is a circular clamping member.

6. The power distributing unit of claim 5, wherein the first wire joint comprises a 15 clamping body made of flexible materials.

7. The power distributing unit of claim 6, wherein the clamping body of the first wire joint defines a groove parallel with an axial direction of the clamping body.

* * * * *